US009343245B2

(12) United States Patent
Oh

(10) Patent No.: US 9,343,245 B2
(45) Date of Patent: May 17, 2016

(54) MOLDED CASE CIRCUIT BREAKER

(71) Applicant: LSIS CO., LTD., Anyang-si, Gyeonggi-do (KR)

(72) Inventor: Ki Hwan Oh, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/446,099

(22) Filed: Jul. 29, 2014

(65) Prior Publication Data

US 2015/0129400 A1 May 14, 2015

(30) Foreign Application Priority Data

Nov. 8, 2013 (KR) ..... 10-2013-0135793

(51) Int. Cl.

| | |
|---|---|
| ***H01H 1/64*** | (2006.01) |
| ***H01H 9/02*** | (2006.01) |
| ***H01H 71/08*** | (2006.01) |
| ***H01H 3/22*** | (2006.01) |

(52) U.S. Cl.

CPC . *H01H 9/02* (2013.01); *H01H 3/22* (2013.01); *H01H 9/0264* (2013.01); *H01H 71/08* (2013.01)

(58) Field of Classification Search

CPC ..... H01H 9/02; H01H 71/08; H01R 9/2408; H01R 9/2416

USPC ..... 200/293, 303; 335/202; 439/717

See application file for complete search history.

(56) References Cited

U.S. PATENT DOCUMENTS 7,132,913 B2 * 11/2006 Whipple ..... H01H 11/0031 335/202

2005/0186859 A1 8/2005 Lias et al.

FOREIGN PATENT DOCUMENTS

| | | |
|---|---|---|
| EP | 1372175 | 12/2003 |
| FR | 2787933 | 6/2000 |
| JP | 02-106861 | 4/1990 |
| JP | 04-064906 | 2/1992 |
| JP | 10-326555 | 12/1998 |
| JP | 11-224707 | 8/1999 |
| JP | 2007-213963 | 8/2007 |
| KR | 10-2005-0085212 | 8/2005 |
| KR | 10-2006-0068576 | 6/2006 |

OTHER PUBLICATIONS

Korean Intellectual Property Office Application Serial No. 10-2013-0135793, Office Action dated Aug. 25, 2014, 4 pages.

European Patent Office Application Serial No. 14179430.5 Search Report dated Mar. 17, 2015, 5 pages.

Japan Patent Office Application Serial No. 2014-173805, Office Action dated May 1, 2015, 4 pages.

Korean Intellectual Property Office Application Serial No. 10-2013-0135793, Notice of Allowance dated Aug. 20, 2015, 2 pages.

Japan Patent Office Application Serial No. 2014-173805, Office Action dated Jan. 5, 2016, 3 pages.

* cited by examiner

*Primary Examiner* — Vanessa Girardi

(74) *Attorney, Agent, or Firm* — Lee Hong Degerman Kang & Waimey; Jonathan King; Jeffrey Lotspeich

(57) ABSTRACT

A molded case circuit breaker, includes: a case; a power side terminal portion and a load side terminal portion formed at two sides of the case; a mounter installed at the terminal portion with a structure to enclose a terminal connector connected to the terminal portion, wherein the mounter includes: a mounting surface for mounting the terminal connector; insulation surfaces extending from two side edges of the mounting surface, and spaced from each other; and a cover surface having an opening, and formed on outer side surfaces of the insulation surfaces so as to cross the insulation surfaces and the mounting surface. Under such configuration, a regulated insulation distance can be obtained, and the terminal connector can be supported more stably.

11 Claims, 9 Drawing Sheets

SPATIAL DISTANCE = a + b + c
CREEPAGE DISTANCE = 2d + 2e + b

MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0135793, filed on Nov. 8, 2013, the contents of which are all hereby incorporated by reference herein in its entirety.

BACKGROUND OF THE DISCLOSURE

1. Field of the Disclosure

The present disclosure relates to a molded case circuit breaker, and particularly, to a molded case circuit breaker capable of fixing a terminal connector thereto with various structures, while obtaining a phase-to-phase insulation distance and a phase-to-ground insulation distance.

2. Background of the Disclosure

Generally, when a molded case circuit breaker performs a trip operation for interrupting a fault current, arc gas of a plasma form occurs in the molded case circuit breaker with electric energy of a high temperature and a high pressure.

In this case, if insulation between different phases, or between the molded case circuit breaker and the ground is insufficient, an electrical contact occurs therebetween, by the arc gas leaked to outside from the molded case circuit breaker. This may cause a secondary short circuit.

In order to solve such problem, the molded case circuit breaker should obtain set phase-to-phase and phase-to-ground insulation distances of a current carrying part.

FIG. 1 is a perspective view illustrating a terminal barrier system of a molded case circuit breaker which has been disclosed in the following cited reference document D1 (U.S. Pat. No. 6,172,586 B1) in accordance with the prior art.

Referring to FIG. 1, the terminal barrier system 10 is installed at a power side and a load side of a case, for each phase. The terminal barrier system 10 obtains a phase-to-phase insulation distance by forming a predetermined interval (space) between a side wall of a lug 12 and a side wall of a mold 11, the lug for connecting an external terminal thereto using a mounting rib formed on an inner side surface of the mold 11 (barrier body).

In the cited reference D1, an insulation distance is increased by obtaining a space, by spacing the mold 11 and a connector (lug 12 or the terminal plate) from each other. Only part of the mold 11 may come in contact with the connector, for a maximized insulation distance.

However, a barrier system, capable of obtaining an insulation distance in a different manner from the conventional barrier system of a molded case circuit breaker, has been required.

SUMMARY OF THE DISCLOSURE

Therefore, an aspect of the detailed description is to provide a molded case circuit breaker capable of satisfying a standard, by obtaining phase-to-phase and phase-to-ground insulation distances with a new structure differentiated from the conventional one.

Another aspect of the detailed description is to provide a molded case circuit breaker capable of stably supporting a terminal connector in a various manner.

To achieve these and other advantages and in accordance with the purpose of this specification, as embodied and broadly described herein, there is provided a molded case circuit breaker, including: a case; a power side terminal portion; a load side terminal portion; and a mounter. The power side terminal portion and the load side terminal portion may be formed at two sides of the case. The mounter may be installed at the terminal portion with a structure to enclose a terminal connector connected to the terminal portion. The mounter includes a mounting surface for mounting the terminal connector; insulation surfaces extending from two side edges of the mounting surface, and spaced from ach other; and a cover surface having an opening, and formed on outer side surfaces of the insulation surfaces so as to cross the insulation surfaces and the mounting surface.

In an aspect of the present invention, an insulation distance can be obtained by using an insulation distance extension portion of a new structure, rather than by using an interval (spatial distance) between a lug, a terminal connector and a terminal plate.

The mounter may be provided with an insulation distance extension portion extending from the cover surface in parallel to the insulation surface.

The insulation distance extension portion may be protruding along an edge of the opening.

The terminal connector may include: a lug having a box structure, and provided with a cavity therein such that an external terminal is inserted thereinto; and a coupling member inserted to one surface of the lug, and configured to fix the external terminal, wherein the insulation surfaces are formed to contact two side surfaces of the lug.

The lug may be provided with an external terminal fitting portion having a structure to enclose the external terminal.

The terminal connector may be a terminal plate having a coupling hole therein, and having a plate structure. The terminal plate may come in contact with the mounting surface.

The mounter may include a recess portion concaved from the cover surface toward inside of the insulation surface; and slits penetratingly-formed at the recess portion.

The mounter may include a shielding unit extending from the mounting surface toward a rear surface of the case, and configured to obtain a phase-to-ground insulation distance.

The shielding unit may include a mounting surface connection portion vertically extending from the mounting surface toward a rear surface of the case; and a supporting portion spaced from the mounting surface, and configured to support the mounting surface connection portion.

The mounter may be detachably assembled into the terminal portion provided in the form of an insertion recess.

The mounting surface may be provided with a separation prevention member having a locking protrusion at one end thereof. One side of the terminal connector may be fixed to the mounting surface by being locked by the locking protrusion.

In the molded case circuit breaker according to the present invention, the terminal connector can be supported more stably, while obtaining a set insulation distance.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
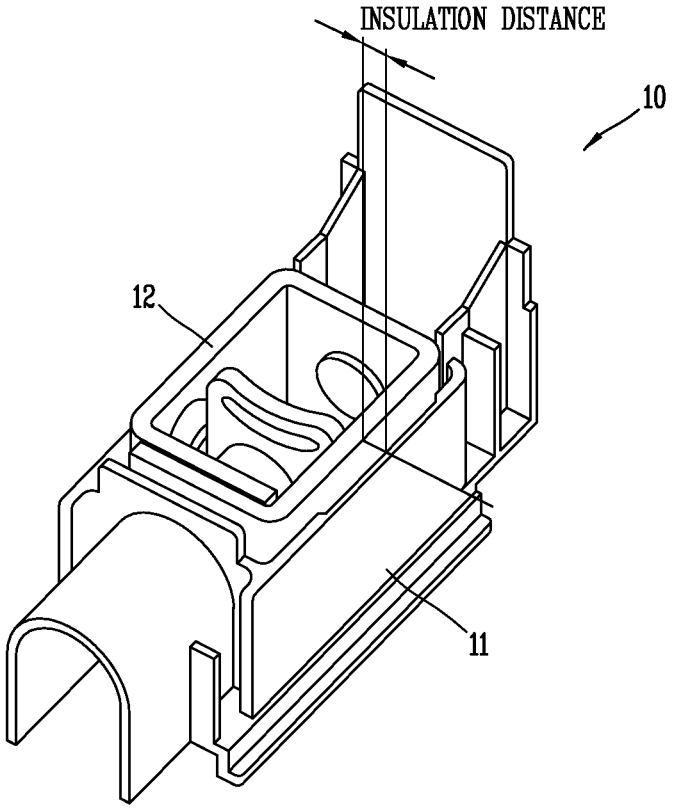
FIG. 1 PRIOR ART
FIG. 1 is a perspective view illustrating a terminal barrier system of a molded case circuit breaker which has been disclosed in the following cited reference document D1 in accordance with the prior art.
Figure 2:
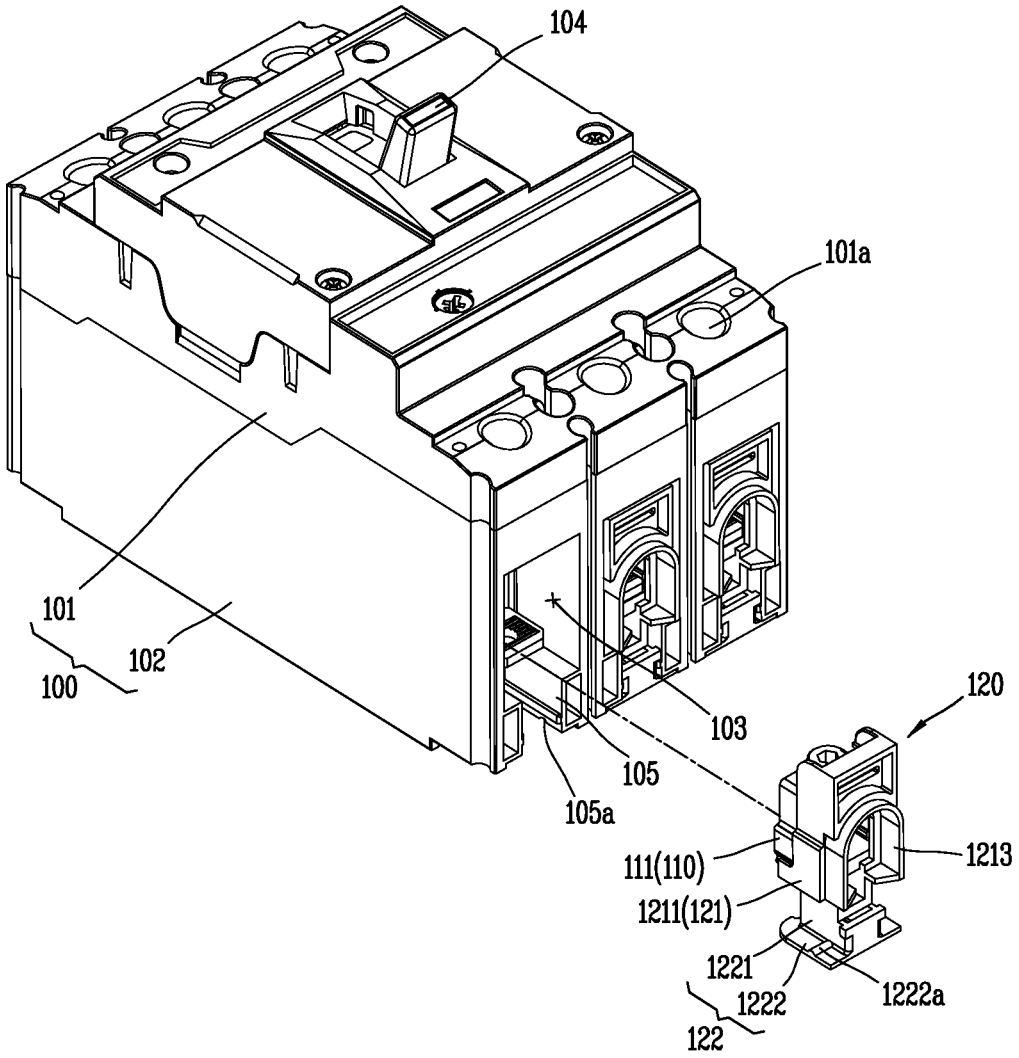
FIG. 2 is a perspective view of a molded case circuit breaker according to an embodiment of the present invention.
Figure 3:
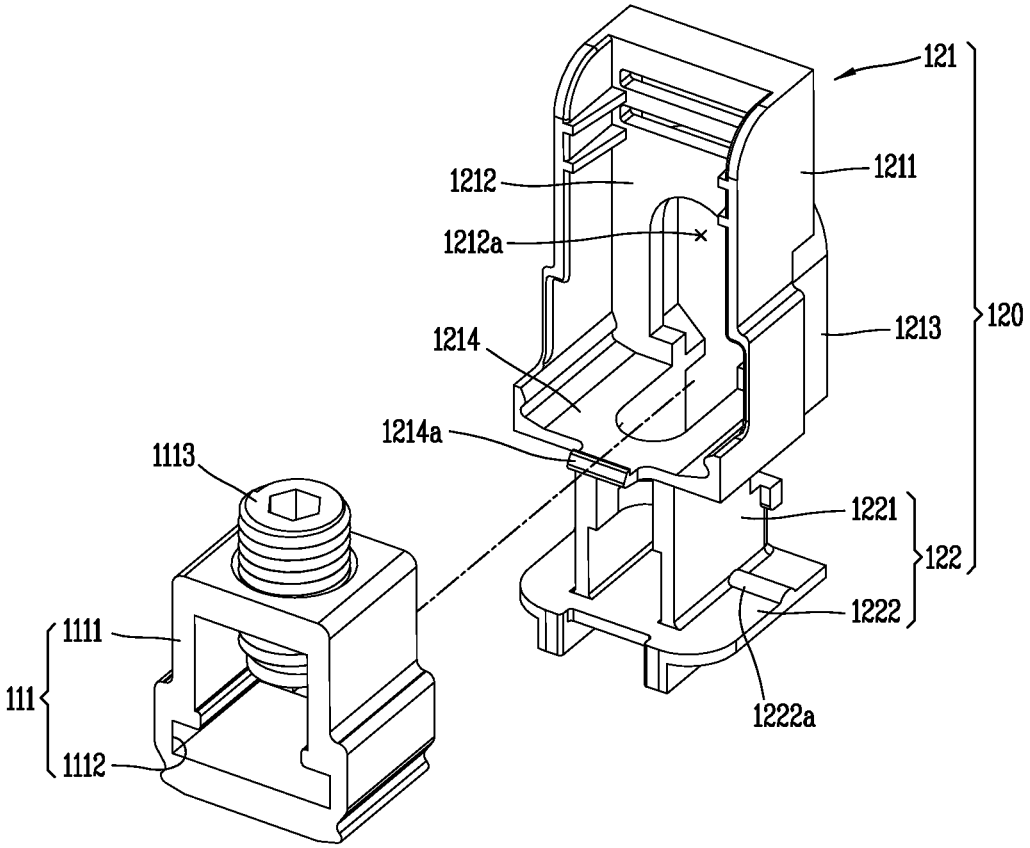
FIG. 3 is a perspective view illustrating a state where a lug has been mounted to an inner side of a mounter, and an exploded view thereof.
Figure 4:
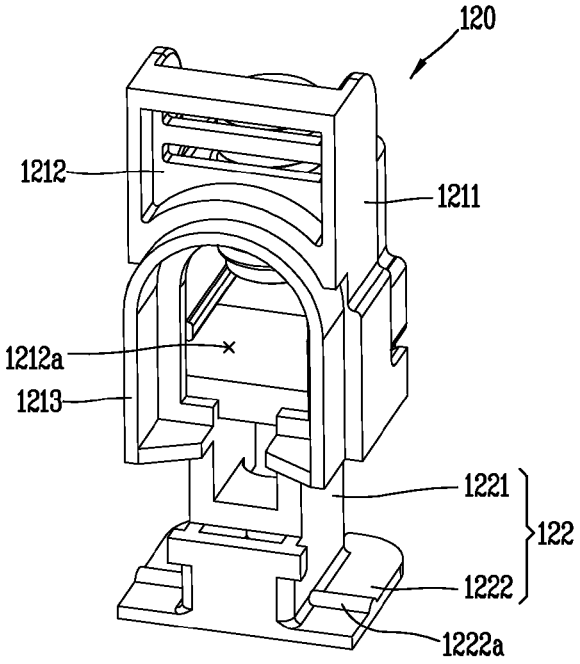
FIG. 4 is a rear perspective view of the mounter of FIG. 3, which was seen from outside.
Figure 5:
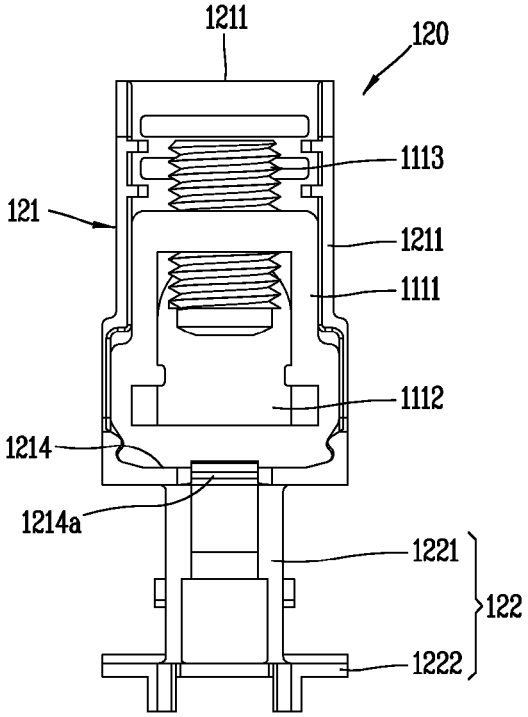
FIG. 5 is a frontal view of FIG. 3.
Figure 6:
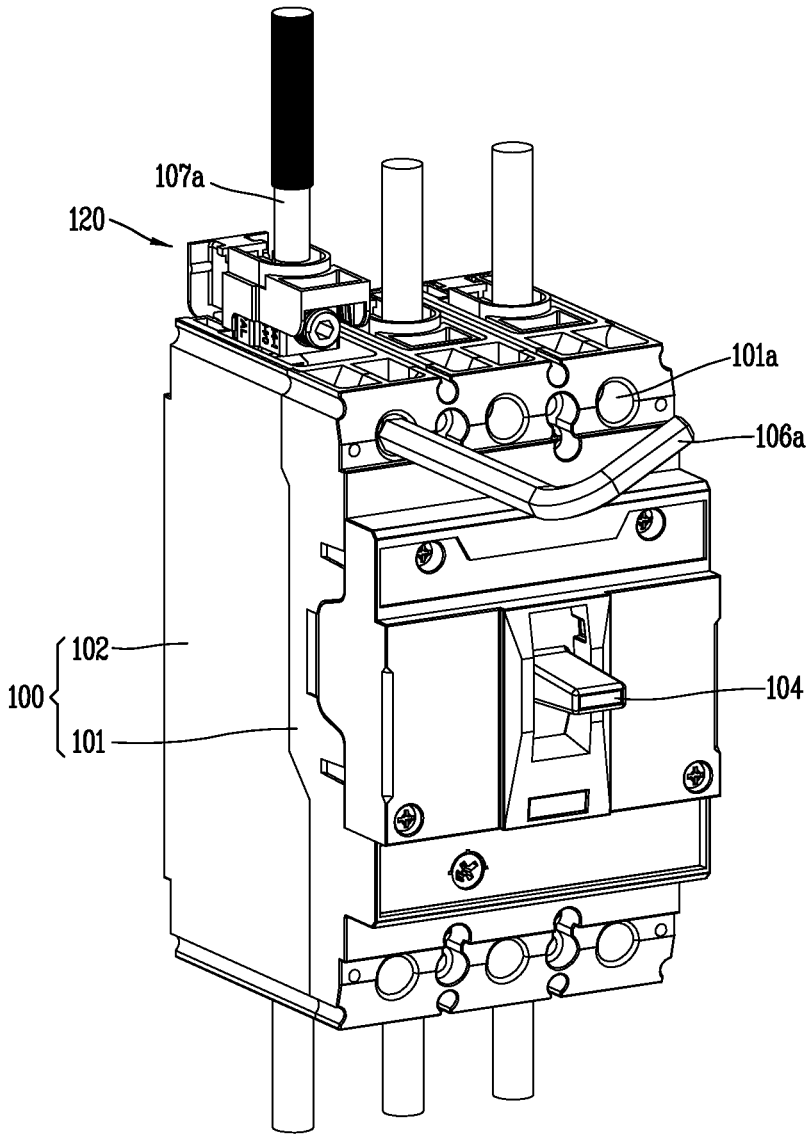
FIG. 6 is a perspective view illustrating a state where a circular external terminal has been assembled into a mounter of the present invention.
Figure 7:
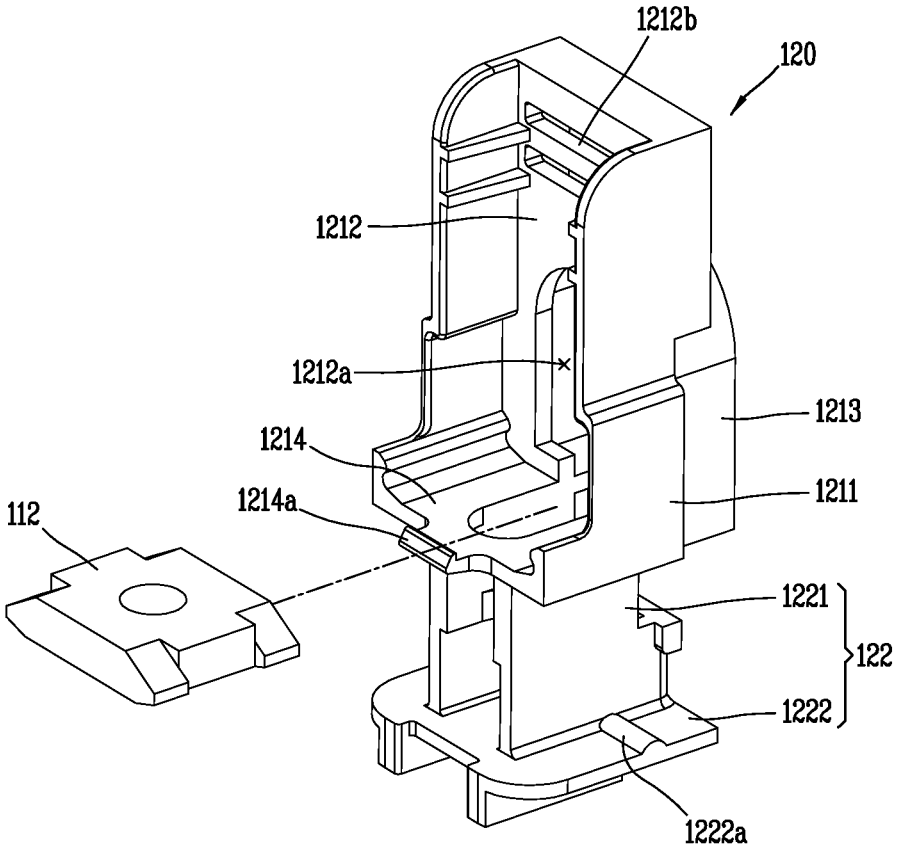
FIG. 7 is a perspective view illustrating a state where a terminal plate has been mounted to inside of a mounter, and an exploded view thereof.
Figure 8:
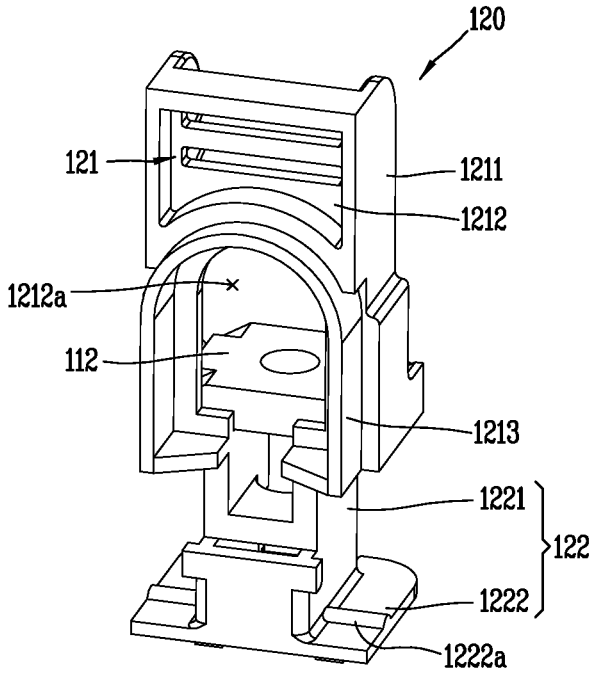
FIG. 8 is a rear perspective view of the mounter of FIG. 7, which was seen from outside.
Figure 9:
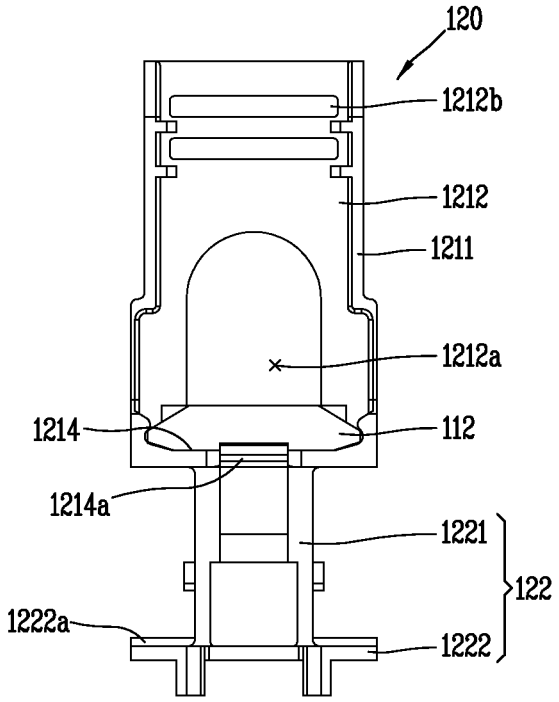
FIG. 9 is a frontal view of FIG. 7.
Figure 10:
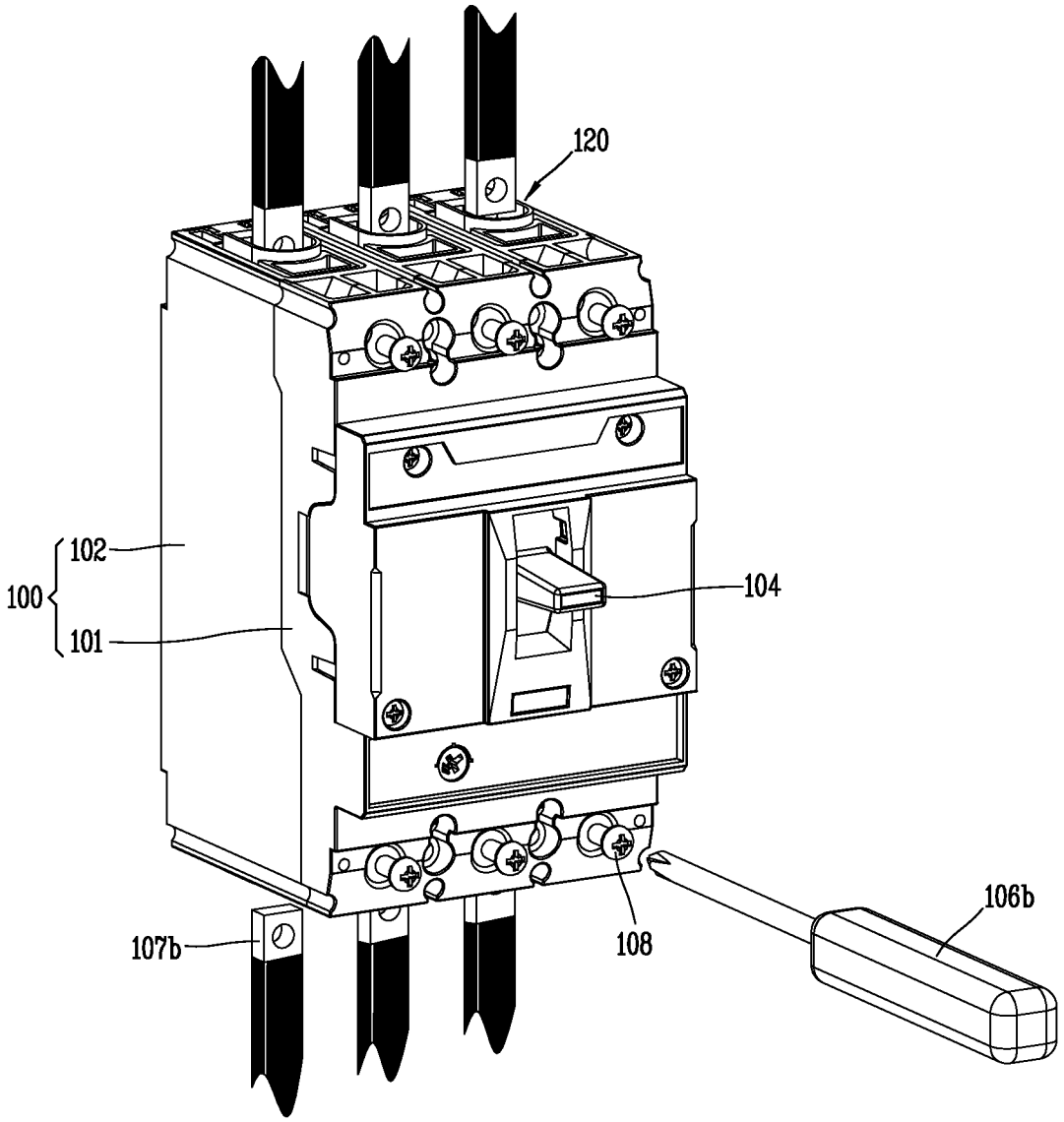
FIG. 10 is a perspective view illustrating a state where a plate-type external terminal has been assembled into a mounter of the present invention.

FIG. 2 is a perspective view of a molded case circuit breaker according to an embodiment of the present invention. FIG. 3 is a perspective view illustrating a state where a lug has been mounted to an inner side of a mounter, and an exploded view thereof. FIG. 4 is a rear perspective view of the mounter of FIG. 3, which was seen from outside. FIG. 5 is a frontal view of FIG. 3. FIG. 6 is a perspective view illustrating a state where a circular external terminal has been assembled into a mounter of the present invention. FIG. 7 is a perspective view illustrating a state where a terminal plate has been mounted to inside of a mounter, and an exploded view thereof. FIG. 8 is a rear perspective view of the mounter of FIG. 7, which was seen from outside. FIG. 9 is a frontal view of FIG. 7. FIG. 10 is a perspective view illustrating a state where a plate-type external terminal has been assembled into a mounter of the present invention; and The present invention relates to a molded case circuit breaker capable of obtaining a regulated insulation distance and capable of stably supporting a terminal connector 110.

Referring to FIGS. 2 to 5, the molded case circuit breaker according to the present invention includes a case 100, a power side terminal portion and a load side terminal portion 103, and a mounter 120. The present invention provides a new type of terminal portion insulating structure capable of insulating arc gas in the terminal portion 103. Such structure is provided to prevent arc gas generated from inside of the case 100 when contacts are separated from each other, from serving as a bridge for connecting current carrying parts of different phases to each other.

The case 100 includes a base 102 and a cover 101, and the base 102 and the cover 101 are detachably coupled to each other by a coupling means such as a snap fit.

A manual handle 104 is rotatably mounted to the cover 101. As a user rotates the manual handle 104, a fixed contact and a movable contact can be turned on/off.

The base 102 includes therein a contact unit consisting of a movable contactor and a fixed contactor configured to contact or be separated from each other; a switching mechanism configured to contact the movable contactor to the fixed contactor, or to separate the movable contactor from the fixed contactor; a trip unit connected to the switching mechanism and configured to interrupt a power of a main circuit when an abnormal current occurs; and an extinguishing unit configured to extinguish an arc generated when the movable contactor is separated from the fixed contactor.

The contact unit, the switching mechanism, the trip unit, the extinguishing unit may be used as basic components of a circuit breaker by those skilled in the art, and may be modified to have various forms and structures. A configuration and an operation thereof have been already well-known to the public, and thus its detailed explanations will be omitted.

The power side terminal portion and the load side terminal portion 103 are provided at two ends of the case 100.

The power side terminal portion and the load side terminal portion 103 are formed in parallel for each phase in the form of insertion recesses.

A vent chute 105 is provided at a lower end of the insertion recess (rear side of the base 102) for each phase, so that arc gas generated from the extinguishing unit can be exhausted to outside through the vent chute 105.

Coupling holes 101*a* are formed at two ends of the cover 101 for each phase. A coupling member 108 such as a screw may be inserted into the insertion recess of the base 102, through the coupling hole 101*a*. A tool, such as a driver 106*b* (refer to FIG. 10) or a hexagonal wrench 106*a* (refer to FIG. 6), may be partially inserted into the coupling hole 101*a*. The coupling member 108 serves to fix the terminal connector 110 to the mounter 120.

The terminal connector 110 may be inserted into the terminal portion 103 of the case 100 by the mounter 120, thereby connecting an external terminal 107*a*, 107*b* to a terminal of the molded case circuit breaker. The terminal connector 110 may include a lug 111 or a terminal plate 112.

The lug 111 may have a box-shaped structure of a closed sectional surface. The lug 111 is open in back and forth directions (insertion direction), and is provided with a cavity therein. Under such configuration, the external terminal 107*a*, 107*b* can be inserted into the cavity.

The lug 111 includes a lug body 1111, an external terminal fitting portion 1112 formed at one side of the lug body 1111 and having a flat C-shaped section, and a coupling hole formed at another side of the lug body 1111.

The external terminal fitting portion 1112 constitutes the lug body 1111, and the plate-type external terminal 107*b* may be fitted into the external terminal fitting portion 1112 with a width greater than that of the rest lug body 1111.

As a female screw recess is formed around the coupling hole of the lug body 1111, a coupling member 1113 may be coupled to the coupling hole.

The coupling member 1113 serves to fix the external terminal 107*a*, 107*b* to the lug 111. As a male screw thread is formed on an outer side surface of the coupling member 1113, the coupling member 1113 may be coupled to the lug 111 through the coupling hole. A hexagonal recess is formed in an upper end of the coupling member 1113, so that a user can rotate the coupling member 1113 right and left using a hexagonal wrench.

If the coupling member 1113 is rotated in one direction, it is inserted into the lug 111 along a coupling direction (111). As a result, the coupling member 1113 fixes the external terminal 107*a*, 107*b* to the lug 111 in a pressing manner. On the other hand, if the coupling member 1113 is rotated in another direction, it is separated from the lug 111. As a result, the pressure applied to the external terminal 107*a*, 107*b* is released.

Referring to FIGS. 7 to 9, the terminal plate 112 has a quadrangular plate structure having a coupling hole therein.

In a case where the external terminal 107*a* has a circular sectional surface, it is preferable to use the lug 111. On the other hand, in a case where the external terminal 107*b* has a plate shape, it is preferable to use the terminal plate 112.

A through hole is formed at the plate-type external terminal 107*b*. The plate-type external terminal 107*b* is laminated on the terminal plate 112, and then the terminal plate 112 and the external terminal 107*b* are coupled to each other by a coupling member 108 such as bolts.

The present invention provides the mounter 120 inserted into the terminal portion 103 of the molded case circuit breaker. The mounter 120 serves to mount the terminal connector 110 to the terminal portion 103 configured in the form of an insertion recess.

The mounter 120 is composed of a mounter body 121 for insulating the terminal connectors 110 of different phases from each other, and a shielding unit 122 for insulating the terminal connector and the earth from each other.

The mounter body 121 and the shielding unit 122 may be integrally formed.

The mounter body 121 may be formed to enclose the terminal connector 110. The mounter body 121 may include a mounting surface 1214 for mounting the terminal connector 110; insulation surfaces 1211 extending from two side edges of the mounting surface 1214, and spaced from ach other; and a cover surface 1212 formed to cross the mounting surface 1214 and the insulation surfaces 1211.

The mounting surface 1214 is a surface parallel to a rear surface of the case 100, and the insulation surfaces 1211 are surfaces parallel to two side surfaces of the case 100. And the cover surface 1212 is a surface crossing the mounting surface 1214 and the insulation surfaces 1211.

The mounting surface 1214 includes a separation prevention member 1214*a* protruding from one end of the mounting surface 1214. The separation prevention member 1214*a* is provided with a locking protrusion at an end thereof, and is elastically supported at the mounting surface 1214. As one end of the lug 111 is fittedly-coupled to the mounting surface 1214 by being locked by the locking protrusion, the lug 111 is prevented from being separated from the mounting surface 1214.

In case of using the terminal plate 112 as the terminal connector 110, one surface of the terminal plate 112 is fixed to the mounting surface 1214, and another surface of the terminal plate 112 is fixed to the plate-type external terminal 107*b*.

The insulation surfaces 1211 may be formed on two side surfaces of the lug 111, thereby reducing the length of the mounter 120 in a width direction.

The cover surface 1212 is disposed on outer side surfaces of the insulation surfaces 1211 so as to cross the mounting surface 1214 and the insulation surfaces 1211, thereby covering inside of the mounter 120.

The cover surface 1212 has a recess structure concaved from one side edge to inside of the insulation surface 1211. One end of the lug 111 is disposed to contact the recessed cover surface 1212.

A plurality of slits 1212*b* are formed in the recess structure of the cover surface 1212, with intervals therebetween. The plurality of slits 1212*b* serve as vents between inside and outside of the mounter body 121.

The cover surface 1212 is provided with an opening 1212*a* communicated with inside of the mounter body 121. Through the opening 1212*a*, the external terminal 107*a*, 107*b* can be inserted into the mounter body 121.

The cover surface 1212 may be provided with an insulation distance extension portion 1213 protruding along a circumference of the opening 1212*a*. Thus, an insufficient insulation distance can be compensated more than in the prior art.

The insulation distance extension portion 1213 is arranged in parallel to the insulation surfaces 1211, or is arranged on the same plane as the insulation surfaces 1211 (i.e., is arranged in parallel to side surfaces of the case 100 for each phase). As the insulation distance extension portion 1213 is interposed between the terminal connectors 110 which are spaced from each other in a side direction of the case 100, a short-circuit between phases due to arc gas can be prevented.

Differences between the conventional cited references and the present invention will be explained in more detail.

In the present invention, an insulation distance indicates a distance for preventing a short-circuit occurring between the terminal connector 110 and an external terminal for each phase. The insulation distance is formed by the sum between a spatial distance and a creepage distance.

Figure 11:
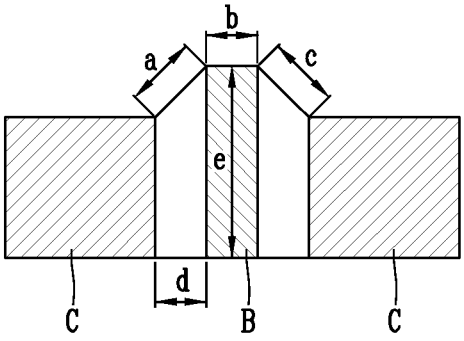
FIG. 11 is a schematic diagram for explaining a term of 'insulation distance' between a terminal connector and a barrier according to the present invention.

FIG. 11 is a schematic diagram for explaining a term of 'insulation distance' between a terminal connector and a barrier according to the present invention.

Referring to FIG. 11, the spatial distance indicates a distance between one terminal connector (C) and another terminal connector (C), which is 'a+b+c'. The creepage distance indicates a distance from one terminal connector (C) and another terminal connector (C) measured along the surface of a barrier (B), which is '2d+2e+b'. Herein, 'a' and 'c' denote straight-line distances from an upper edge of the terminal connector C to an upper edge of the barrier B. 'b' denotes a thickness of the barrier B, 'd' denotes a shortest distance between the terminal connector C and the barrier B, and 'e' denotes a height of the barrier B.

In the conventional cited reference D1, the terminal barrier B (mould) and the terminal connector C (lug) have an interval therebetween (spatial distance: a+b+c). Under such configuration, the spatial distance between the terminal connector (C) and the terminal barrier (B) can be increased, and thus an insulation distance can be obtained.

However, in the present invention, a height (h) of the insulation distance extension portion, a barrier disposed between the terminal connectors 110 adjacent to each other is increased. Thus, the creepage distance is increased than the spatial distance, thereby obtaining an insulation distance.

That is, in the present invention, a spatial distance between the insulation surface 1211 and the terminal connector 110 is reduced. However, a height of the insulation surface 1211 which is disposed between the terminal connectors 110 is increased by the insulation distance extension portion 1213. This can increase a creepage distance, and thus can satisfy a standard of an insulation distance.

The shielding unit 122 may include mounting surface connection portions 1221 extending toward a bottom surface of the case 100 from a bottom surface of the mounting surface 1214, and spaced from each other in a side direction; and a supporting portion 1222 for connecting end portions of the mounting surface connection portions 1221 thereto.

The mounting surface connection portion 1221 and the supporting portion 1222 have a plate structure, and are disposed to be perpendicular to each other.

A fitting recess is formed between the mounting surface 1214 and the supporting portion 1222, toward outside of the mounting surface connection portion 1221. The vent chute 105 of the terminal portion 103 is inserted into the fitting recess. Under such configuration, the mounter 120 is inserted into the insertion recess of the terminal portion 103 in a sliding manner.

A locking protrusion 1222*a* is formed at the supporting portion 1222, and a locking recess 105*a* is formed at a bottom surface of the vent chute 105 in correspondence to the locking protrusion 1222*a*. As the locking protrusion 1222*a* and the locking recess 105*a* are engaged with each other, a coupled state of the mounter 120 to the case can be maintained.

The mounting surface connection portion 1221 of the shielding unit 122 obtains a phase-to-ground insulation distance between the terminal plate 112 and a rear surface of the case 100, thereby preventing a short circuit between ground and the terminal plate 112, a current carrying part.

In the present invention, the mounter 120 having the terminal connector 110 can be stably mounted to the terminal portion 103 of the case. Under such configuration, a creepage distance of the barrier becomes longer than a spatial distance between the barrier and the terminal connector 110. As a result, a phase-to-phase insulation distance set by a standard can be obtained.

Further, the terminal connector 110 can be fixed to the terminal portion more stably, with various structures thereof.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker, comprising:

a case;

a power side terminal portion and a load side terminal portion formed at two sides of the case;

a mounter installed at the terminal portion with a structure to enclose a terminal connector connected to the terminal portion, wherein the mounter includes:

a mounting surface for mounting the terminal connector;

insulation surfaces extending from two side edges of the mounting surface, and spaced from each other, wherein the terminal connector is placed between the insulation surfaces;

a cover surface having an opening, and connecting rear portions of the insulation surfaces so as to cross the insulation surfaces and the mounting surface and cover space between the insulation surfaces, and an insulation distance extension portion protruding from a rear surface of the cover surface in a direction that the terminal connector is inserted into the mounting surface.

2. The molded case circuit breaker of claim 1, wherein the terminal connector is a terminal plate having a coupling hole therein, and having a plate structure, and wherein the terminal plate comes in contact with the mounting surface.

3. The molded case circuit breaker of claim 1, wherein the mounter includes:

a recess portion concaved from the cover surface toward inside of the insulation surface; and slits penetratingly-formed at the recess portion.

4. The molded case circuit breaker of claim 1, wherein the mounter is detachably assembled into the terminal portion provided in the form of an insertion recess.

5. The molded case circuit breaker of claim 1, wherein the mounting surface is provided with a separation prevention member having a locking protrusion at one end thereof, and wherein one side of the terminal connector is fixed to the mounting surface by being locked by the locking protrusion.

6. The molded case circuit breaker of claim 1, wherein the insulation distance extension portion extends from the cover surface in parallel to the insulation surface.

7. The molded case circuit breaker of claim 6, wherein the insulation distance extension portion is protruding along an edge of the opening.

8. The molded case circuit breaker of claim 1, wherein the terminal connector includes:

a lug having a box structure, and provided with a cavity therein such that an external terminal is inserted thereinto; and a coupling member inserted into one surface of the lug, and configured to fix the external terminal, wherein the insulation surface is formed to contact two side surfaces of the lug.

9. The molded case circuit breaker of claim 8, wherein the lug is provided with an external terminal fitting portion having a structure to enclose the external terminal.

10. The molded case circuit breaker of claim 1, wherein the mounter includes a shielding unit extending from the mounting surface toward a rear surface of the case, and configured to obtain a phase-to-ground insulation distance.

11. The molded case circuit breaker of claim 10, wherein the shielding unit includes:

a mounting surface connection portion vertically extending from the mounting surface toward a rear surface of the case; and a supporting portion spaced from the mounting surface, and configured to support the mounting surface connection portion.

* * * * *